United States Patent [19]

Sun et al.

[11] 4,102,780

[45] Jul. 25, 1978

[54] METHOD AND APPARATUS FOR MAGNETIC SEPARATION OF PARTICLES IN A FLUID CARRIER

[75] Inventors: Jack Ji-Nong Sun; Dartrey Lewis, both of Trenton, N.J.

[73] Assignee: S. G. Frantz Company, Inc., Trenton, N.J.

[21] Appl. No.: 665,265

[22] Filed: Mar. 9, 1976

[51] Int. Cl.[2] ..... B03C 1/30

[52] U.S. Cl. ..... 209/39; 209/213; 209/223 R

[58] Field of Search ..... 209/213, 214, 39, 40, 209/232, 231, 155, 158, 215, 223 R; 210/222, 223

[56] References Cited

U.S. PATENT DOCUMENTS

| | | | |
|---|---|---|---|
| 509,728 | 11/1893 | Gillespie | 209/232 X |
| 2,056,426 | 10/1936 | Frantz | 209/214 X |
| 2,258,194 | 10/1941 | Queneau | 209/232 |
| 2,714,959 | 8/1955 | Mielke | 209/214 |
| 2,976,995 | 3/1961 | Forrer | 209/232 X |
| 3,037,711 | 6/1962 | Businger | 209/39 X |
| 3,351,195 | 11/1967 | Hukki | 209/39 |
| 3,575,293 | 4/1971 | Nelson | 209/214 |
| 3,595,386 | 7/1971 | Hradel | 209/39 |
| 3,716,946 | 2/1973 | Graf | 209/40 X |
| 3,877,578 | 4/1975 | Morey | 209/215 |

*Primary Examiner*—Robert Halper

*Attorney, Agent, or Firm*—Brumbaugh, Graves, Donohue & Raymond

[57] ABSTRACT

Particles suspended in a fluid carrier are differentially separated by, first, grading the particles into fractions of equal settling rates and, second, separating the equal-settling particles of each fraction according to the magnetic susceptibilities of the particles. The particulate sample to be separated is passed through a two-path parallel flow system. In one path, the sample is selectively graded, by elutriation, into equal-settling fractions. Each such fraction then flows directly to the second path, where it crosses a magnetic field at a velocity proportional to its settling rate. Such proportionality between settling rate and flow velocity provides a residence time which ensures that the degree of deflection, in response to gravitational and magnetic forces, required for separate recovery of magnetic particles, on the one hand, and non-magnetic particles, on the other hand, will be attained within the active length of the magnetic field. Provision is made for simultaneous adjustment of the flow rates in the respective paths, thereby allowing selection among fractions of different settling rates while, at the same time, maintaining the desired flow rate proportionality between the two paths. The flow rates are also independently adjustable to provide for other flow requirements within the individual flow paths.

22 Claims, 7 Drawing Figures

METHOD AND APPARATUS FOR MAGNETIC SEPARATION OF PARTICLES IN A FLUID CARRIER

BACKGROUND OF THE INVENTION

1. Field of the Invention

This invention relates to a method, and to apparatus for carrying out the method, for separating particles suspended in a fluid carrier according to the magnetic susceptibilities of the particles. While not so limited, the invention has particular application to the separation in a fluid medium of particles 100 mesh (147 microns) or less in size.

2. The Prior Art

As is well known, the differential responses of materials to magnetic forces may be used as a basis for separating the materials in accordance with their particular magnetic susceptibilities. One device embodying this principle is described in U.S. Pat. No. 2,056,426, issued on Oct. 6, 1936 to S. G. Frantz. Magnetic separators constructed in accordance with the Frantz patent are manufactured and sold by S. G. Frantz Company, Trenton, New Jersey, assignee of the present application, under the trademark ISODYNAMIC. Unlike other separators, the Frantz ISODYNAMIC separator employs an isodynamic magnetic field, i.e., a field which exerts a substantially constant force on a particle of given susceptibility regardless of the position of the particle within the field, and as a consequence is capable of making positive and quite fine separations. This sensitivity, which enables delicate separations of many materials throughout the entire spectrum of susceptibilities down through the diamagnetic, makes the Frantz ISODYNAMIC separator useful in a wide variety of research and industrial applications and has led to its worldwide adoption by university, government and industrial laboratories and by basic research institutions.

The operating range of the Frantz ISODYNAMIC separator, however, has heretofore been limited almost entirely to dry flowable materials having a particle size greater than about 100 to 200 mesh (147 to 74 microns). Consequently, in the many instances where because of the nature of the material or for other reasons it is desirable or advantageous to work with wet or other fluid suspended samples and/or to effect separation of materials of finer particle sizes, prior art magnetic separating apparatus and techniques have been unavailable. It is the object of the present invention to fulfill these and other requirements of the prior art.

SUMMARY

There is provided, in accordance with the invention, a method, and an apparatus for practicing such method, for separating a mixture of diverse-size particles in accordance with the magnetic susceptibilities of the particles in which the mixture is first graded according to settling rate in a fluid carrier to provide one or more fractions of substantially uniform settling rates and each fraction is thereafter passed through a magnetic field at a velocity proportional to the settling rate of such fraction in the fluid carrier. In this way, the particles passing through the magnetic field at any one time are all of substantially the same settling rate and remain within the active length of the magnetic field for a time sufficient to enable separation of magnetic particles from non-magnetic particles. The fraction or fractions are produced by adjustment of the upward flow rate of the fluid carrier through a first flow path, so as to cause the particles to settle through the first flow path in accordance with their respective settling rates. The velocity at which each fraction is passed through the magnetic field is controlled by delivering each fraction suspended in the fluid carrier to a second flow path, which communicates for this purpose with the first flow path, through which the flow rate varies in proportion to the change in flow rate made in the first flow path to produce that particular fraction. Preferably, the flow rate through the second flow path is so varied in response to adjustments in the flow rate through the first flow path as to maintain the ratio of the velocity at which each fraction is passed through the magnetic field to the settling rate of such fraction in the first flow path at a substantially constant value.

In addition to controlling the upward flow rate in the first flow path so as to produce fractions of substantially uniform settling rates, the upward flow rate is also preferably controlled to regulate the density or frequency of particle flow to the second flow path. This is done to avoid creating an overly dense concentration of particles within the second flow path such as might interfere with or occlude the separation of the particles within the magnetic field. According to the invention, the density of particle flow to the second flow path may be controlled automatically by monitoring the number or density of particles settling through the first flow path and adjusting the upward flow rate of the fluid carrier through the first flow path in response to such monitoring to provide the desired density of particle flow to the second flow path.

In a preferred embodiment, the particle fractions are passed through the magnetic field along an inclined path and the magnetic field is established so as to exert a magnetic force on particles susceptible to the field which acts in opposition to the gravitational force acting on the particles. Advantageously, a substantially isodynamic magnetic field is employed to separate the particles. The field generating means preferably permits adjustment of the field intensity to permit separation of particles of different magnetic susceptibilities.

According to a further feature of the invention, the desired flow rate ratio between the first and second flow paths is established and maintained by supplying the fluid carrier to the first and second flow paths from a common source and so arranging the flow paths to provide for an equal pressure drop across each path. Adjustments in the flow rate through the first flow path to produce the desired particle fractions will thus automatically result in proportionate variations of the flow rate through the second flow path, with the result that the particles of each fraction will flow through the magnetic field at a velocity proportional to the settling rate of the fraction in the first flow path. The first and second flow paths may additionally be arranged to return the fluid flow therethrough to the fluid source to permit continuous operation of the system.

BRIEF DESCRIPTION OF THE DRAWINGS

For a better understanding of the invention, reference may be made to the following description of exemplary embodiments thereof, taken in conjunction with the attached figures of the accompanying drawings, in which.

DETAILED DESCRIPTION

Theory

For purposes of illustration, the invention is described in detail herein with reference to the Frantz ISODYNAMIC magnetic separator. Although the invention is employed to particular advantage with a separator of this type, it will be understood that such use is exemplary only and that the invention has application to other types of magnetic separators as well. Similarly, although the fluid carrying the particles to be separated is sometimes referred to herein, for convenience, as water, it will be appreciated that other liquids, for example, methanol, and including colloidal suspensions of magnetic particles as described in U.S. Pat. Nos. 3,788,465 and 3,215,572 or other magnetic fluids such as solutions of paramagnetic substances, may be used or that, if desired, a gas, such as air, may be used as the carrier in place of a liquid.

In a magnetic separator constructed in accordance with the teachings of Frantz U.S. Pat. No. 2,056,426, particle flow through the active field is along an elongate chute, illustrated schematically at 10 in FIG. 1, which, in the orientation of interest here, is arranged with its transverse axis in a vertical plane and its longitudinal axis inclined at an angle $\alpha$ to the horizontal. As described in the Frantz patent, an isodynamic magnetic field is established parallel to the chute's longitudinal axis so as to produce a gradient upward and perpendicular to the direction of particle flow. In the absence of a fluid in the chute 10, the forces acting on a particle 12 of mass $m$ moving along the inclined chute are the gravitational force $F_G$ and the magnetic force $F_M$, assuming for purposes of illustration that the particle is paramagnetic. It may be shown that the gravitational force $F_G$ acting on the particle 12 is proportional to the mass $m$ of the particle and that the magnetic force $F_M$ is proportional to $km/d$, where $k$ is the volume susceptibility of the particle and $d$ is its density. Assuming that the particle 12 remains within the isodynamic field for a comparatively long time and over a comparatively long distance, so that the ultimate direction of travel of the particle within the field is substantially the direction of the resultant force $F_R$ of the gravitational force $F_G$ and the magnetic force $F_M$ acting thereon, it may be seen that the particle 12 will undergo differential movement transversely of the chute 10, and thus may be separated, in accordance with the relative value of $k/d$, i.e., its specific susceptibility.

Figure 1:
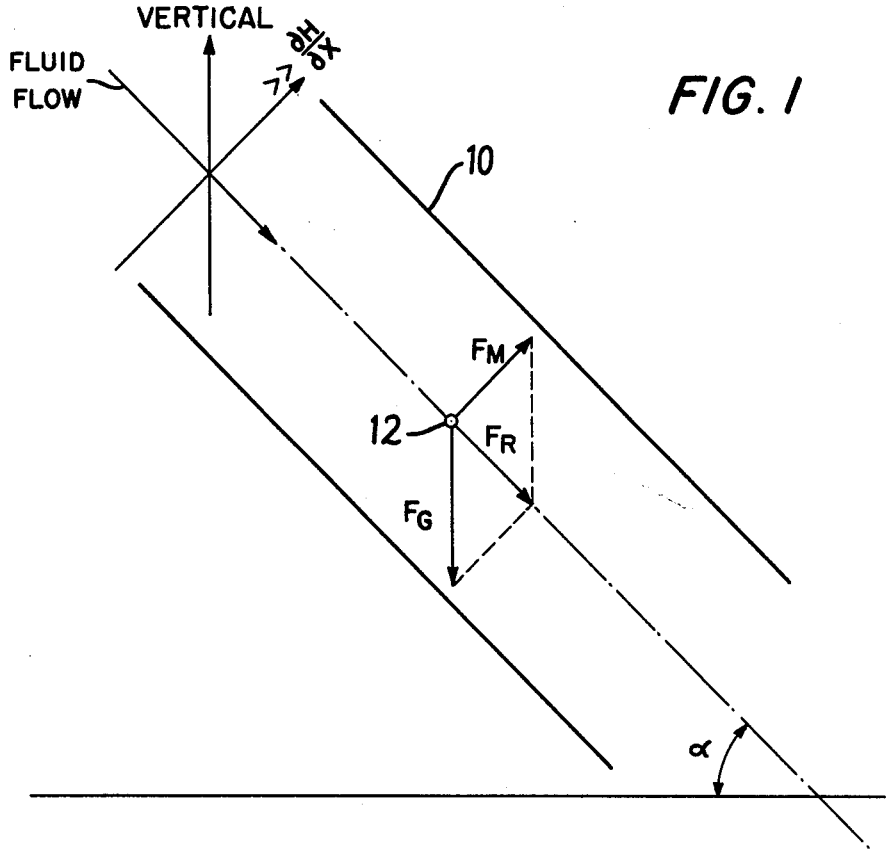
FIG. 1 is a vector diagram of the forces acting on a magnetic particle moving through an isodynamic field along an inclined path in the absence of a fluid carrier.

In the situation depicted in FIG. 1, the field strength has been adjusted such that the magnetic force $F_M$ offsets the gravitational force $F_G$ to produce a resultant force $F_R$ on the particle 12 parallel to the axis of the chute 10. In this circumstance, of course, the particle 12 would continue to move axially along the chute 10 with no tendency to deflect toward either the magnetic side or the non-magnetic side of the chute. As the gravitational force $F_G$ and the magnetic force $F_M$ are both proportional to the mass of the particle, the ratio $F_M/F_G$ is independent of particle size. The magnetic field strength productive of a resultant force parallel to the chute axis is therefore characteristic of the material, so that different materials may be separated from one another by utilizing different field strengths. The field strength may be readily controlled by varying the current supply to the coils of the separator, as is well known.

When a liquid, e.g. water, is present in the chute 10, the magnetic force $F_M$ on the particle 12 remains proportional to its volume susceptibility $k$, but the gravitational force $F_G$ is opposed by the buoyancy of the liquid. Consequently, the liquid-suspended particles move in the field and are separated according to the relative values of $k/(d_p-d_l)$ where $d_p$ is the density of the particle and $d_l$ is the density of the liquid.

For the purpose of the invention, it may be assumed that particles within the size range of most interest, i.e., from approximately 5 microns up to approximately 200 microns, move within the carrier liquid under an applied force, whether gravitational or magnetic, in accordance with Stokes law for viscous resistance. Such particles are accelerated by the applied force almost instantaneously to a terminal velocity at which the drag force on the particle due to viscous resistance equals the applied force. The terminal velocity due to the applied force is in the direction of the force and of a magnitude directly proportional to it. Hence, the terminal velocity of the particle due to the gravitational force $F_G$ may be termed $V_G$ and is usually referred to as the settling velocity or rate. The terminal velocity $V_{G+M}$ due to the resultant $F_{G+M}$ of the gravitational force $F_G$ and the magnetic force $F_M$ is related to the settling velocity $V_G$ as the resultant force $F_{G+M}$ is to the gravitational force $F_G$, that is:

$$\frac{V_{G+M}}{V_G} = \frac{F_{G+M}}{F_G} \tag{1}$$

As settling velocity $V_G$ decreases with particle size, it will be apparent from equation (1) that in order to obtain the same magnetic deflection of both small and large particles the small particles must remain in the magnetic field for a longer residence time $t$ than the larger particles. That is to say, for a constant magnetic field strength and constant specific magnetic susceptibility $(k)/(d_p-d_l)$, the same magnetic deflection will occur if the quantity $V_G \times t$ remains constant. Since the ratio of magnetic and gravitational forces acting on a particle does not change with particle size, this holds true for all particles of like specific magnetic susceptibility $(k)/(d_p-d_l)$ within the size range governed by Stokes law for viscous flow, i.e., from approximately 5 microns up to approximately 200 microns. The invention is not limited to particles of less than 200 microns size, but beyond this size range the velocity-to-force relationship of equation (1) is no longer independent of particle size and may be expressed as:

$$\left(\frac{V_{G+M}}{V_G}\right)^a = \frac{F_{G+M}}{F_G} \quad (2)$$

The exponent $a$ varies from 1.0, for small particles which undergo viscous flow (Equation (1)), to 2.0, for particles large enough to undergo turbulent flow, with a gradual variation in $a$ from 1.0 to 2.0 for particles of intermediate size. In operation, the resultant gravitational and magnetic force $F_{G+M}$ is preferably made approximately equal to the gravitational force $F_G$ but different from it in direction. Under this condition:

$$\frac{V_{G+M}}{V_G} = \frac{F_{G+M}}{F_G} = 1$$

for any size particle.

In order to maintain $V_G \times t$ constant for various settling rates $V_G$, the residence time $t$ of the particles may be varied by appropriate regulation of the velocity $V_L$ of the fluid carrying the particles. In accordance with the invention, $V_L$ is varied in relation to changes in settling velocity $V_G$ such that the ratio $V_L/V_G$ is substantially constant. This condition will produce substantially the same magnetic deflection of particles of the same specific magnetic susceptibility independently of particle size. It will be appreciated, therefore, that where the proper proportionality is maintained between $V_L$ and $V_G$ particles suspended in a liquid of density $d_l$ may be separated in accordance with their specific magnetic susceptibilities $(k)/(d_p-d_l)$. This is true where the particles within the magnetic field at any given time are all of substantially equal settling rate and are within the size range governed by Stokes law. As noted, larger sized particles may be separated in accordance with the invention by adjusting the angle $\alpha$ and the magnetic field strength so that the resultant gravitational and magnetic velocity $V_{G+M}$ approximately equals the settling velocity $V_G$.

Figure 2:
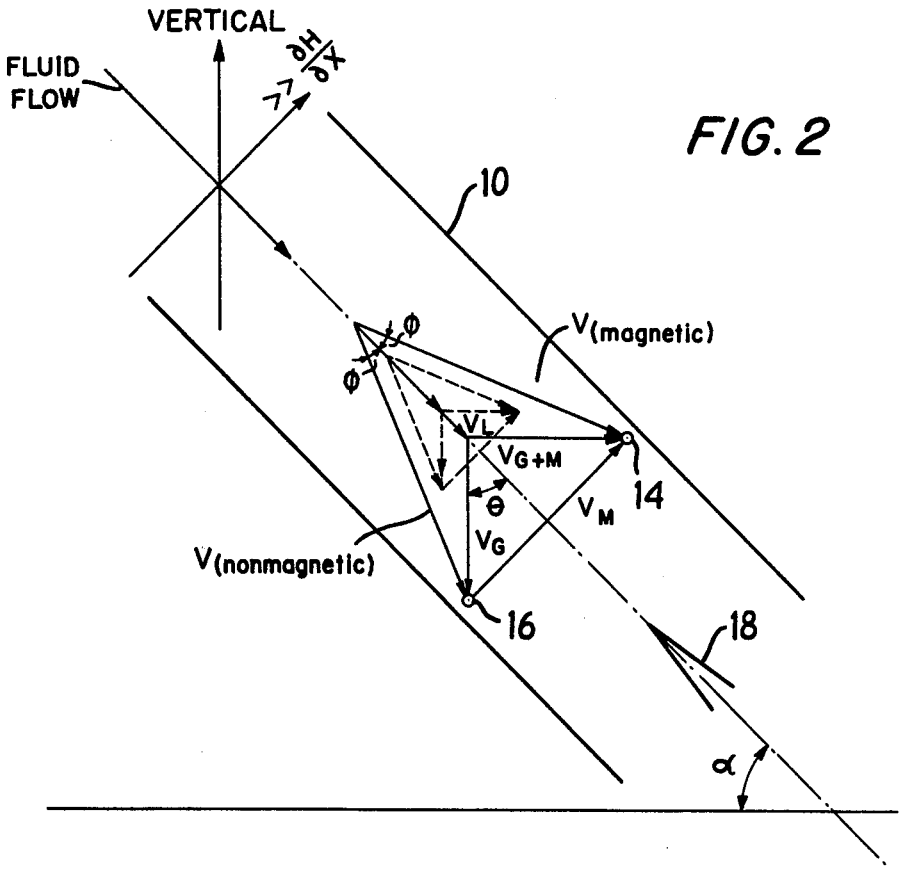
FIG. 2 is a vector diagram of the component and resultant velocities of a magnetic particle and a non-magnetic particle moving through an isodynamic field along an inclined path in the presence of a fluid carrier.

The advantages of governing the fluid velocity $V_L$ through the chute 10 in proportion to the settling velocity $V_G$ of the particles to be separated may be further appreciated by reference to the velocity vector diagram of FIG. 2.

FIG. 2 depicts a velocity vector diagram of the relative movements of a paramagnetic particle 14 and a nonmagnetic particle 16 which are suspended in a liquid flowing axially along an inclined chute 10 and through an isodynamic magnetic field having an increasing gradient upward and perpendicular to the direction of fluid flow. The particles 14 and 16 are assumed to have substantially the same settling velocity.

The velocity components acting on the particles include the mean velocity of the liquid $V_L$, the velocity due to the gravitational force $V_G$, in the case of the paramagnetic particle 14, the velocity due to the magnetic force $V_M$, and the resultant velocity due to gravitational and magnetic forces $V_{G+M}$. As in FIG. 1, the chute 10 is arranged in a vertical plane and is inclined within that plane to the horizontal at an angle $\alpha$. The velocities $V_L$, $V_G$ and $V_M$ all act in the vertical plane of the chute and in the relative directions and magnitudes indicated, the component $V_G$ acting vertically downward at an angle $\theta$ to the axis of the chute, the component $V_M$ acting upward at 90° to the axis of the chute, and the component $V_L$ acting parallel to the axis of the chute.

The magnitude of $V_M$ is determined by the field strength of the isodynamic field, and may readily be controlled by adjustment of the current to the magnetizing coils for the field. In the situation depicted in FIG. 2, $V_M$ has been chosen such that the deflection of the paramagnetic particle 14 from the axis of the chute 10 is equal to the gravitational deflection of the non-magnetic particle 16 from the chute axis and such that the magnitude of the velocity $V_{G+M}$ of the magnetic particle 14 relative to the liquid equals the magnitude of the settling velocity $V_G$ of the non-magnetic particle 16. The angle of inclination $\alpha$ of the chute may of course be varied to adjust the magnitude of the gravitational deflection. The resultant velocity and direction of the non-magnetic particle 16 is indicated in FIG. 2 by the vector V(nonmagnetic) and is the vector sum of $V_G$ and $V_L$. The resultant velocity and direction of the magnetic particle 14 is indicated as V(magnetic) and is the vector sum of $V_G$, $V_L$ and $V_M$. For the assumed value of $V_M$, both resultant vector components V(magnetic) and V(nonmagnetic) deviate from the axis of chute 10 by the angle $\phi$. Hence the angle $2\phi$ determines the total separation of the two particles over the active length of the isodynamic field. It may be seen from consideration of FIG. 2 that the angle $2\phi$ remains substantially constant for materials of like magnetic susceptibility $(k)/(d_p-d_l)$ but different settling rates if $V_L$ is changed in the same proportion as the change in settling rate. For example, if the settling rate between two samples of the same magnetic susceptibility decreases by 50%, a 50% reduction in $V_L$ should be made.

The case of a 50% reduction in both $V_G$ and $V_L$, with a consequent 50% reduction in $V_{G+M}$ in accordance with equation (1), is illustrated in FIG. 2 by the dotted vector lines. Inspection of FIG. 2 shows that the angle $2\phi$ between the resultant velocity vectors for the magnetic particle 14 and the non-magnetic particle 16 is unchanged in the latter case. The particle velocities are halved and the time $t$ in the magnetic field is doubled. Accordingly, the distance the two particles will separate over the active length of the field will also remain unchanged. It will be appreciated that this facilitates separate recovery of the magnetic particles from the non-magnetic particles at the discharge end of the chute, as, for example, by means of a divider 18 positioned along the axis of the chute.

It will also be appreciated from FIG. 2 that if the ratio of $V_L$ to $V_G$ is changed, a ratio of 1 to 1 being depicted in FIG. 2, the angle $2\phi$ will also change. Thus if $V_L$ is increased relative to $V_G$, $2\phi$ will correspondingly decrease with the result that the magnetic deflection will also fall off. On the other hand, if $V_L$ is reduced relative to $V_G$, $2\phi$ will increase and a greater magnetic deflection will be obtained, thereby enhancing the separation of materials. This may be further demonstrated mathematically, noting from FIG. 2 that the velocities $V_G$ and $V_{G+M}$ of the two particles relative to that of the liquid are equal and, consequently, that the forces $F_G$ and $F_{G+M}$, respectively, producing these velocities are equal and in the same directions as their respective velocities. Hence the force vector diagram has the same shape as the velocity vector diagram; therefore:

$$V_M/V_G = F_M/F_G = 2 \sin \theta \quad (3)$$

For a small paramagnetic particle (5 microns - 200 microns), the magnetic force $F_M$ is given by:

$$F_M = KvH\,\delta H/\delta X \tag{4}$$

where $K$ is the volume susceptibility, $v$ is the volume ($cm^3$), $H$ is the magnetic field intensity (gauss), and $\delta H/\delta X$ is the field gradient (gauss/cm).

The gravitational force $F_G$ may be expressed as:

$$F_G = v\,(d_p - d_l)\,g, \tag{5}$$

where $d_p$ is the density of the particle ($gr/cm^3$), $d_l$ is the density of the carrier liquid ($gr/cm^3$), and $g$ is the gravitational acceleration ($cm/sec^2$).

Combining equations (3), (4) and (5):

$$\frac{F_M}{F_G} = \frac{KvH\frac{\delta H}{\delta X}}{v(d_p - d_1)g} = 2\sin\theta;$$

and rewriting:

$$\frac{k}{(d_p - d_1)} = \frac{2\,g\sin\theta}{H\frac{\delta H}{\delta X}} \tag{6}$$

Equation (6) shows that for separation of particles having a small magnetic susceptibility $k$, the angle $\theta$ should be relatively small and both the field strength H and the gradient $\delta H/\delta X$ should be comparatively large. Conversely, for separating particles with large susceptibilities $k$, the angle $\theta$ should be relatively large and both H and $\delta H/\delta X$ fairly small. Equation (6) also evidences, as previously stated, that particles carried in a fluid are separated according to their relative values of $(k)/(d_p - d_l)$.

Apparatus

Figure 3:
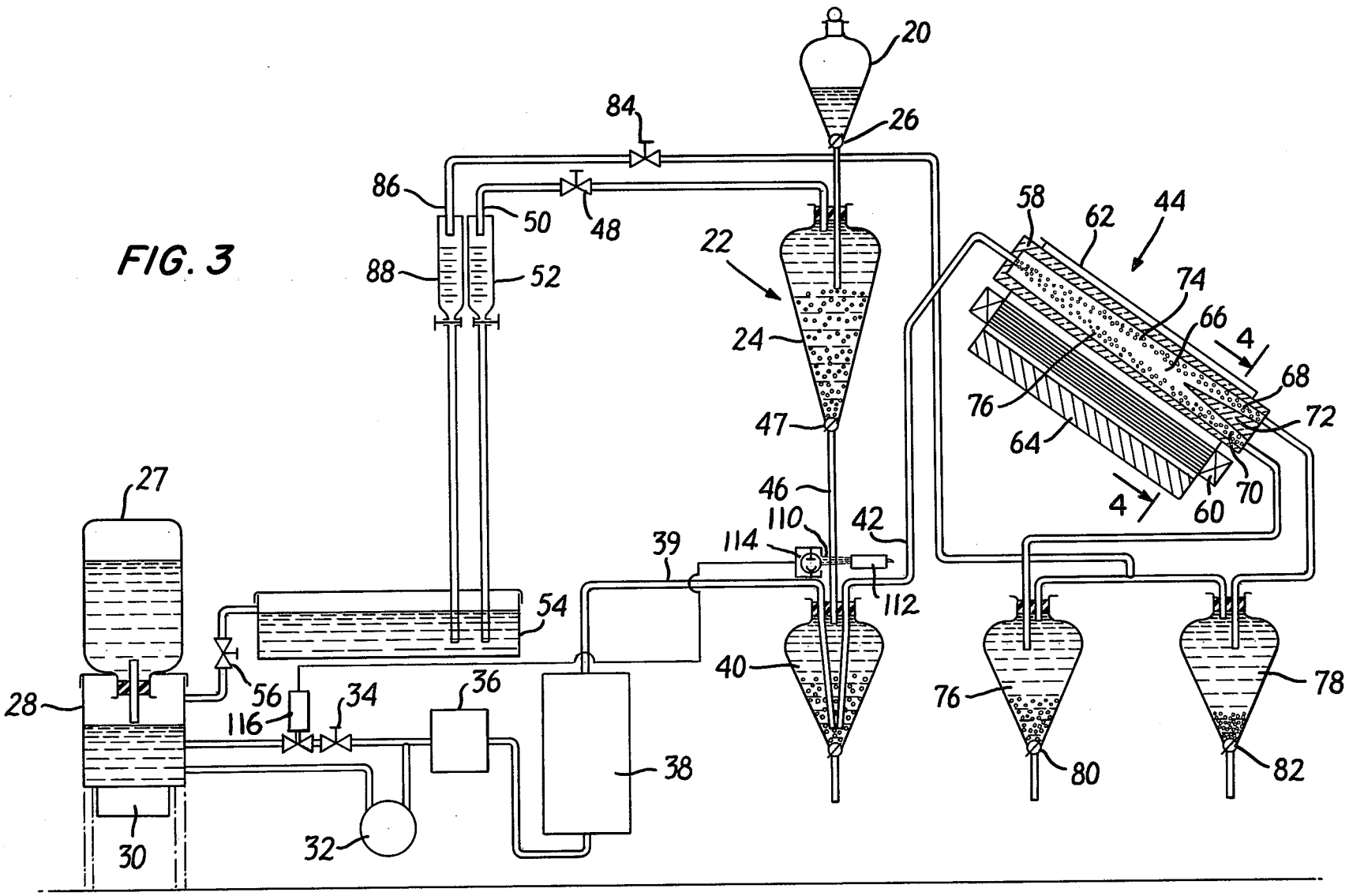
FIG. 3 is a schematic side elevational view of a representative embodiment of the invention, showing the magnetic separator in vertical cross section for clarity of illustration.

In accordance with a further feature of the invention, apparatus is provided for practicing the foregoing separation technique. FIG. 3 illustrates an illustrative embodiment of such apparatus, especially adapted for use with water as the fluid carrier.

The apparatus of FIG. 3 is in the form of a recirculating hydraulic system having two parallel flow paths, with a common supply, through which the particle sample to be separated is passed in sequence. In the first flow path, the sample is graded by elutriation according to settling rate. That is to say, the sample is divided into a number of fractions each of which contains only particles of substantially the same settling rate. Each equal settling fraction is passed, directly following its concentration in the elutriator path, to the second flow path in which the particles, now all of one setting rate, are subjected to a magnetic field and separated in accordance with their specific magnetic susceptibilities.

The particle sample, following preparation as described hereinafter, is placed in the charging funnel 20 of an elutriator 22, from which it is introduced into an elutriating funnel 24 through a stopcock 26. The elutriating liquid, e.g., water, is stored in an inverted bottle 27 arranged to maintain a constant head in a reservoir 28. If desired, a thermostatically controlled heater 30 of any suitable design may be provided to maintain the temperature of the liquid in reservoir 28 within predetermined limits. Such temperature control might be employed, for instance, to eliminate dissolved air from the liquid supply so as to minimize the escape of air elsewhere in the system where it could interfere with the process. The liquid is drawn from the reservoir 28 by a pump 32, the output of which is return coupled to the reservoir 28 through a by-pass valve 34. The pump output is also coupled through a mechanical filter 36, flow meter 38 and line 39 to the bottom of a lower funnel 40. The flow rate to funnel 40 is regulated by means of the by-pass valve 34 and the flow meter 38.

The pump 32 may be of any type capable of delivering a uniform output without substantial entrapment of air; e.g., a gear-type positive displacement pump has been found satisfactory. In a like manner, the filter 36 and flow meter 38 may be of any appropriate design. The filter 36, for example, may be of the cartridge type and selected to filter out particles too fine to settle out elsewhere in the system. Flow meter 38 may be of the ball float-type and, if desired, may incorporate provision for both coarse and fine flow adjustment.

From the funnel 40, the flow branches into two parallel paths, one through the elutriator 22 and the other, by way of line 42, through the magnetic separator 44. Within the elutriator, the water flows upwardly through an elutriating tube 46 and stopcock 47 to the elutriating funnel 24. Generally, any form of elutriator capable of effecting grading of the particle sample into one or more fractions of substantially uniform settling rate may be used in accordance with the invention. It has been found, however, that the elutriating apparatus depicted in FIG. 3, when used with the elutriating tube shown in FIG. 6, affords improved results for the purpose of the present invention. It is accordingly described herein by way of illustration, and is more fully described and claimed in the commonly owned, copending application Ser. No. 665,266, now abandoned filed concurrently herewith by Jack Sun for Elutriator. An alternative type of elutriator useful in implementing the invention is shown in FIG. 7.

Figure 5:
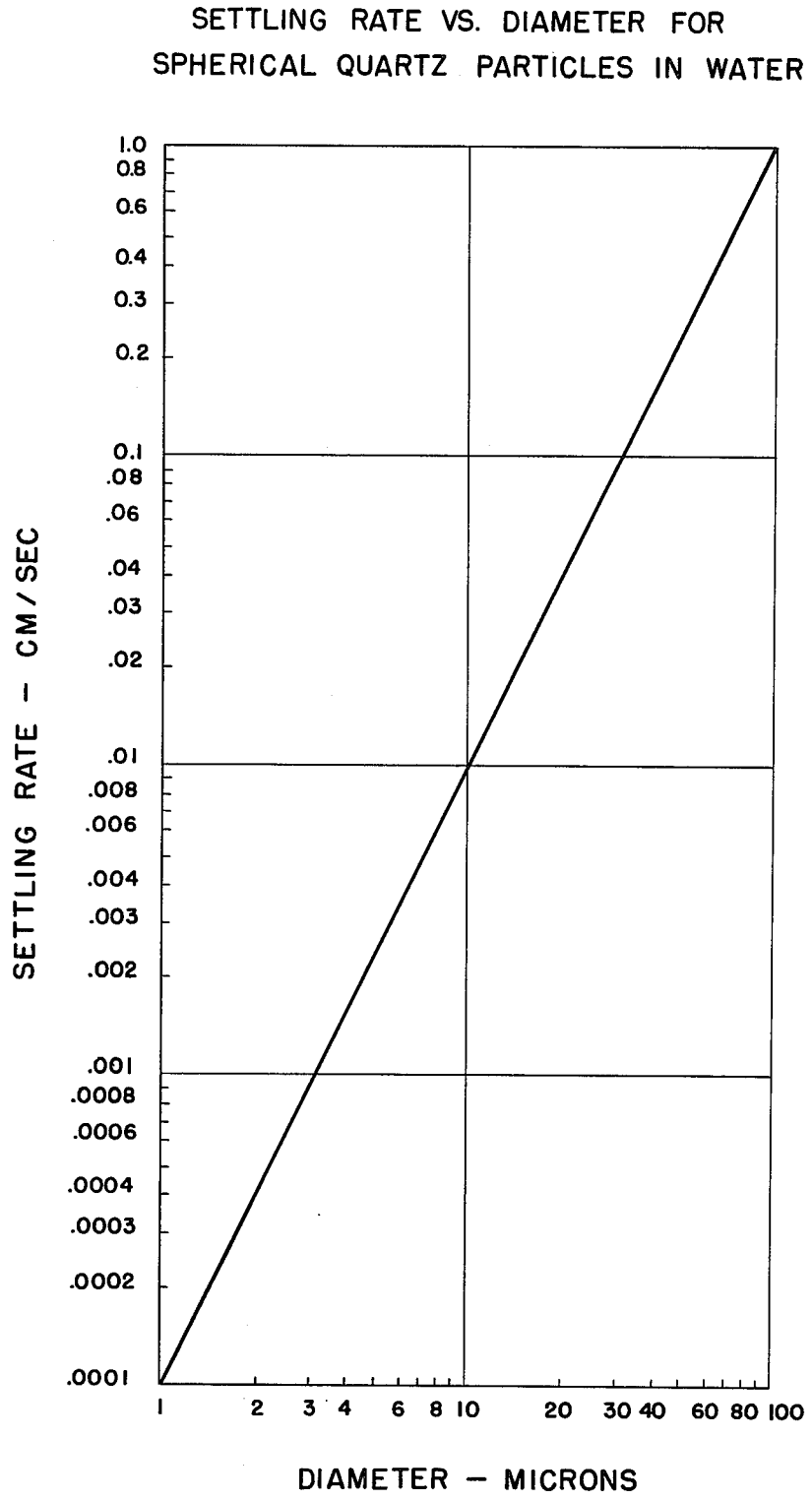
FIG. 5 is a plot of settling rate vs. diameter for spherical quartz particles in water.

In the elutriating apparatus of FIG. 3, those particles having a settling rate greater than the current in tube 46 descend and collect in the lower funnel 40, whereas particles of lower settling rates are retained in the upper funnel 24 and tube 46. As is well known in the elutriating art, the maximum diameter of funnel 24 should be selected relative to the diameter of the elutriating tube 46 so as to provide a ratio between the rate of flow through the tube 46 to that across the maximum diameter of the funnel 24 suitable for processing the full range of particle sizes of interest. For example, spherical quartz particles in the size range of from 1 to 100 microns settle in water according to the plot of FIG. 5. Thus, if all particles ranging from 100 microns (settling rate of 1cm/sec) down to 10 microns (0.01 cm/sec) were to be treated, the maximum diameter of funnel 24 should stand in relation to the diameter of tube 46 such that the ratio of the flow rate through tube 46 to that across the maximum diameter of funnel 24 is on the order of 100:1.

Upon leaving funnel 24, the elutriating liquid passes through a valve 48 and is discharged through a nozzle 50 into a measuring tube 52. The tube 52 connects with a receiving tank 54 where any particles carried with the effluent from the funnel 24 may be recovered. If not previously removed from the sample by decantation or if not filtered out by filter 36, particles of 5 microns or less in size may be collected here. If desired, the overflow from the receiving tank 54 may be returned to the reservoir 28 to allow for continuous operation. An overflow control valve 56 is provided for this purpose.

The fraction of the sample which settles out in the lower funnel 40 is carried by the liquid flow into line 42 and is delivered therethrough to the inlet end of the magnetic separator 44. At any given time, therefore, the particles fed to the separator 44 have a substantially uniform settling rate. To insure pickup of the particles by the line 42, the output end of line 39 and the inlet end of line 42 extend well within the funnel 40 and preferably converge toward the funnel bottom. The outflow from line 39 will thus tend to agitate the particles and aid their entry into line 42.

Figure 4:
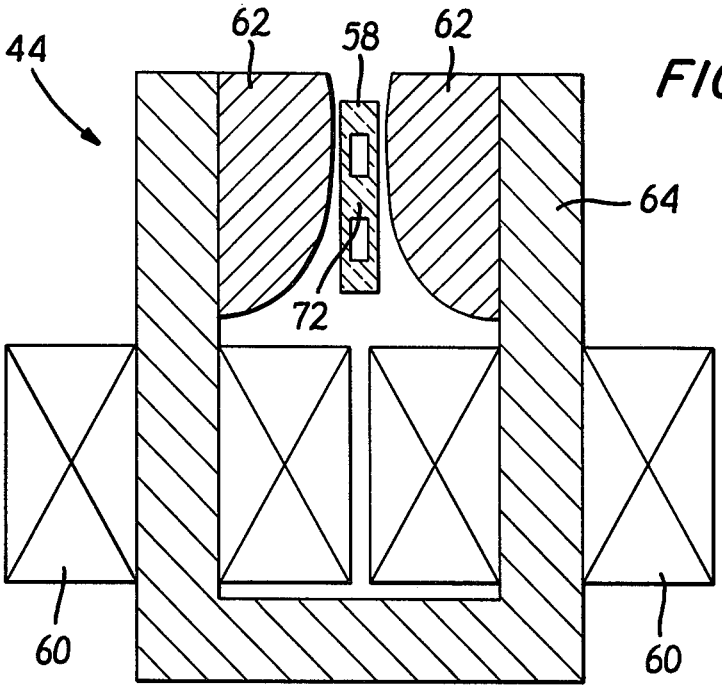
FIG. 4 is a detail vertical sectional view taken along the line 4—4 in FIG. 3 and looking in the direction of the arrows.

As illustrated in FIGS. 3 and 4, the magnetic separator 44 comprises a Frantz ISODYNAMIC separator, having an inclined chute 58, magnetizing coils 60, pole pieces 62 and a yoke 64 in accordance with the disclosure of the Frantz U.S. Pat. No. 2,056,426. Since the separator is depicted in longitudinal cross section in FIG. 3, only one magnetizing coil 60 and one pole piece 62 are shown. The chute 58 is a liquid-tight enclosure composed of a non-magnetic, preferably transparent, material, such as Plexiglass, and is shaped internally (see FIG. 3) to form a tapered flow channel 66 which diverges in the direction of the outlet end of the chute. At the outlet end, the flow channel 66 is divided into two outlets, one 68 for magnetic particles and the other 70 for non-magnetic particles, by a divider 72. If desired, the flow channel 66 may be further divided to provide more than two outlets.

As described in Frantz U.S. Pat. No. 2,056,426, the pole pieces 62 are contoured so as to produce therebetween an isodynamic field. With the separator and chute oriented as depicted in FIGS. 3 and 4, i.e., with the plane of the field and the transverse plane of the chute in the gravitational plane, the isodynamic field will exert a magnetic force $F_M$ in the direction indicated in FIG. 1 tending to urge paramagnetic particles toward the upper side of the flow channel 66 in opposition to the gravitational force $F_G$. Particles susceptible at the applied magnetic field strength, indicated at 74 in FIG. 3, will therefore be deflected from the non-magnetic particles, indicated at 76, and be discharged from the chute 58 through the outlet 68, the non-magnetic particles exiting through the outlet 70. The separate products are collected in suitable receptacles, such as the funnels 76 and 78 (FIG. 3), and are drawn off through stopcocks 80 and 82.

Although the gravitational plane orientation of FIGS. 3 and 4 is preferred, the transverse plane of the chute and magnetic field plane may be tilted relative to the vertical if desired. Suitably, the longitudinal axis of the chute 58 is inclined to the horizontal at an angle, designated $\alpha$ in FIGS. 1 and 2, of 30° or more. Smaller angles may however be used. A vibrator (not shown) may also be provided to vibrate the chute 58 longitudinally to aid particle flow.

The overflow from the collecting funnels 76 and 78 is returned to the receiving tank 54 by way of a valve 84, nozzle 86 and measuring tube 88. Since, as shown in FIG. 3, the nozzle 50 for the elutriation path and the nozzle 86 for the magnetic separation path are at the same height, and since both paths are commonly fed through the lower funnel 40, the pressure drop across each path is the same. Hence the flow rates through the two paths are proportional to one another. Moreover, it has been found that, as a practical matter, the flow rate proportionality between the paths, specifically between the mean fluid velocity in elutriator tube 46, closely approximating $V_G$, and the mean fluid velocity in the chute 58 $V_L$, is substantially constant over a wide range of flow rates. It follows, therefore, that the mean chute velocity $V_L$ for any specific equal settling fraction delivered to the chute 58 from the elutriator 22 will be proportional to the settling rate $V_G$ of the fraction.

The specific value of the ratio of chute velocity to elutriator velocity may be selected as desired by varying the flow resistance of one or both flow paths. This may be done by adjusting the valves 48 and 84 or, preferably, by changing the size or length of the flow lines in the paths. The individual flow rates in the two paths, as well as their ratio, may be checked by means of the measuring tubes 52 and 88.

As noted, in general any suitable form of elutriator may be used in accordance with the invention, including, by way of example, the devices shown in FIGS. 3 and 7. The elutriator 22 of FIG. 3 has the advantage of allowing the highest settling rate fractions to be concentrated first. This can afford a substantial time saving where low settling rate fractions are not of particular interest, since there is no need to wait for settlement of the slower settling particles before reaching the more rapidly settling fractions. In addition, when used with the elutriating tube structure of FIG. 6, the arrangement of FIG. 3 provides equal settling fractions at fine intervals and with quite good uniformity of settling rate within the fractions, characteristics which are preferred for optimum magnetic separation according to the present invention.

As is more fully described in the aforementioned copending application Ser. No. 665,266, it has been found that the settling rates of particles in smoothwalled cylindrical elutriating tubes are subject to fluctuation because of the effect of cross sectional flow variations within the tubes and the interaction of the particles with other particles in the suspension. The tube structure illustrated in FIG. 6 overcomes these deficiences.

Figure 6:
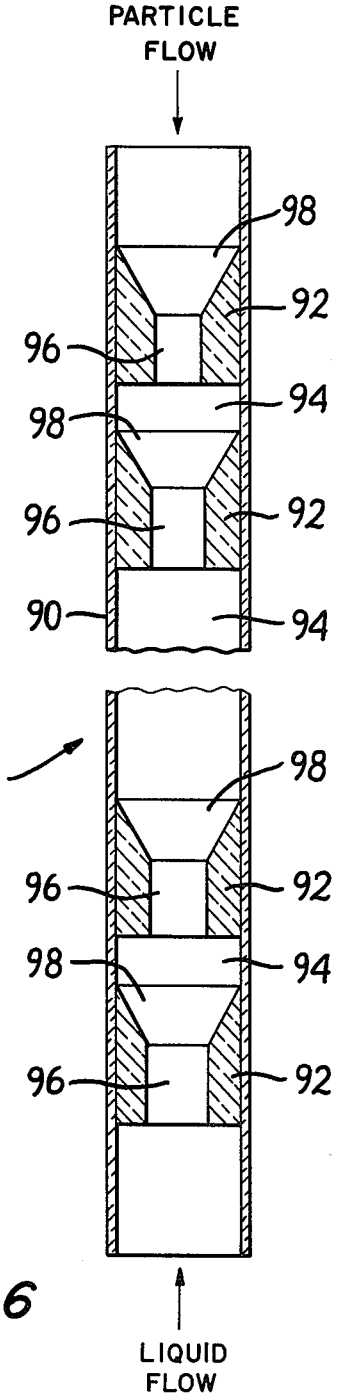
FIG. 6 is a vertical sectional view of an improved form of elutriator tube useful in practicing the invention.
Figure 7:
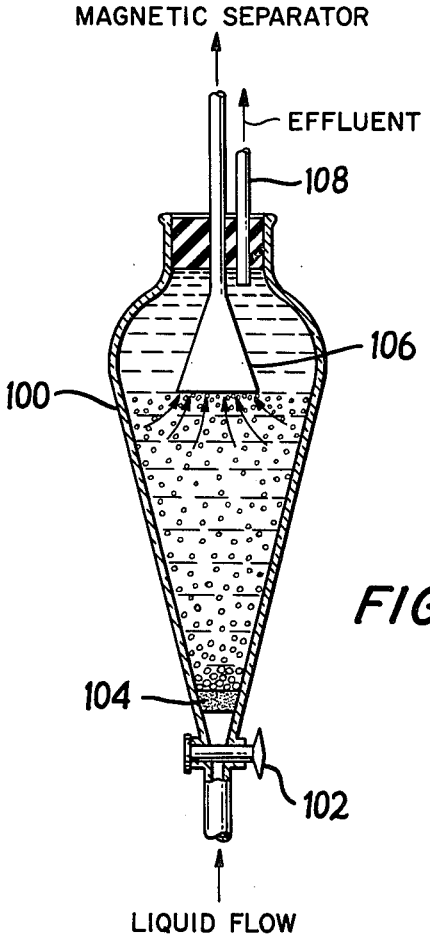
FIG. 7 is a vertical sectional view of another type of elutriator useful in practicing the invention.

Briefly, the elutriating tube of FIG. 6 includes an outer tubular member 90 along which a number of plugs 92 (four being shown for purposes of illustration) are spaced so as to form a series of chambers 94. Liquid flow through the tube is upward and particle flow is downward, as indicated by the arrows. Each plug 92 is formed with an axial orifice 96, tapered at the upstream end, as at 98, or at both ends, to merge with the wall of the tubular member 90. Since the liquid velocity is greater at the center of the orifices than either at the orifice walls or in the chambers, eddies are formed in the chambers 94. As a result, the particles are caused continually to move up and down between adjacent chambers, thereby minimizing the aforementioned effects of flow rate variations and interparticle actions on settling rates. The axial length of the chambers 94 may be adjusted as needed for any particular sample to maximize particle interchange between chambers. Also, the diameter of the orifices 96 may be varied among the plugs to obtain a desired distribution of particles along the tube 46. For example, the orifices in lower plugs may be increased to provide a uniform or decreasing concentration of particles in successive chambers 94. Settling rate uniformity within the fractions may be improved, within limits, by use of additional chambers 94. The number of plugs 92 provided in the tube 46 for any given sample will therefore depend upon the degree of uniformity desired. Six or seven plugs should be satisfactory for most applications.

The alternative elutriator arrangement of FIG. 7 is useful when the lowest settling rate fractions are to be collected first. It consists of a conical vessel 100 into which the elutriating liquid enters through a stopcock 102. A porous plug 104 adjacent the bottom of the vessel serves to equalize the cross-sectional flow distribution within the vessel. The particles, which are charged into the vessel 100 in any convenient way, are suspended in the rising liquid with those of the lowest settling rate at the top. A probe 106 is inserted into the vessel to the level at which the lowest settling rate particles are suspended and abstracts these particles with liquid for delivery to the magnetic separator. After the initial fraction has been drawn off, flow through the vessel 100 may be increased by the desired interval or intervals progressively to remove larger particles. Preferably, the probe 106 is located on or near the axis of vessel 100 so as to sample the suspended particles centrally of the vessel. This tends to minimize the effect on settling rates of variations in liquid velocity across the cross-section of the vessel. The effluent from the vessel 100 flows through an overflow 108 for return to the receiving tank 54 or other disposal.

OPERATION

The sample to be separated is suitably prepared for elutriation by thoroughly mixing the particles with the elutriating liquid to provide a free-flowing suspension. With certain materials, e.g., materials which tend to flocculate, it might be desirable to employ a dispersing agent, such as sodium hexametaphosphate or the like. If a dispersing agent is used, it should also be added to the liquid supply 27. It might also be desirable in certain instances to vibrate the sample suspension by ultrasonic or other means, either with or without the use of a dispersing agent. Further, either excessively large particles or excessively small particles, or both, may be removed from the sample beforehand by sieving or decantation, although such particles may also be removed in the elutriating process itself. Alternatively, fine particles might be removed by appropriate selection of the filter 36, and very fine particles, for example, 5 microns or less in size, might be collected in the receiving tank 54. The sample is then placed in the charging funnel 20 and is introduced into the elutriating funnel 24 by opening stopcock 26.

With the pump 32 operating so there is flow through both paths to the receiving tank 54, the flow rate of the liquid is adjusted, by means of the by-pass valve 34 and the flow meter 38, such that only those particles with the highest settling rate will settle out and will be delivered to the magnetic separator 44. Since, as noted above, the flow rate through the separator chute 58 is proportional to the flow rate through the elutriator tube 46, the equal-settling fraction collected at the bottom of the funnel 40 will flow through the separator chute at a velocity $V_L$ proportional to the settling rate $V_G$ of the fraction.

Several factors bear on the choice of the initial value of $V_L$. As an upper limit, $V_L$ should not exceed and preferably is at least slightly lower than that velocity at which, in the absence of an applied magnetic field, all of the particles are just confined to the non-magnetic outlet 70. This constraint applies regardless of settling rate and serves to insure that substantially no non-magnetic particles will appear in the magnetic concentrate. Within this limit, any velocity is generally acceptable for $V_L$, subject to the following considerations. The value of $V_L$ must be low enough to allow both the magnetic particles and the non-magnetic particles alike to be sufficiently deflected by the opposed magnetic and gravitational forces acting thereon such that they may be separately recovered. That is to say, $V_L$ should be selected so as to provide a sufficiently long particle residence time $t$ within the active length of the magnetic field. In the case of chute 58, therefore, $V_L$ should be low enough that the magnetic particles will at least cross to the magnetic side of the divider 72. As discussed in connection with FIG. 2, the slower the fluid flow, the greater the deflection between the two products and thus the greater the sensitivity of the separation. This, however, will result in decreased throughput. Higher values of $V_L$, while yielding greater throughputs, reduce sensitivity. Also, at the minimum $V_L$ must be fast enough to clear the particles out of the chute after they have been deflected by the gravitational or magnetic forces, as the case may be, in order to prevent such particles from occluding the deflection and movement along the chute of other particles. Even small accumulations of particles along the flow channel 66 interferes with particle flow.

In this connection, it should be noted that the number of particles fed to the chute 58 following an adjustment in elutriator flow rate depends upon the magnitude of the flow rate interval over which the adjustment was made. Unduly large intervals are undesirable for two reasons: (1) particles of mixed sizes (non-uniform settling rates) are delivered to the chute and (2) the number of particles delivered to the chute at any one time may be so great as to lead to the aforementioned occlusion within the chute. Preferably, therefore, the elutriator flow rate is so controlled as not only to provide particles of substantially uniform settling rate but also to provide them in a quantity which can be handled properly by the chute 58.

If desired, such control of the elutriator flow rate may be automated. In FIG. 3, for example, a light beam 110 from a source 112 might be passed through the tube 46 and a photocell 114 used to monitor the number of particles settling through the tube per unit time. The photocell could then be arranged, as through a motor-driven valve 116, to make appropriate adjustments of the liquid flow rate in response to such measurements to provide a substantially constant flow of particles to the separator 44.

Once selected, $V_L/V_G$ remains substantially constant over a wide range of flow rates. The stability of $V_L/V_G$ can be checked during operation by means of the measuring tubes 52 and 88, and any adjustment in either or both flow paths needed to restore the ratio of the predetermined value may be made with the valves 48 and 84 or by otherwise changing the flow resistance of the paths.

Having selected the initial values of $V_G$ and $V_L$, operation is continued until the desired magnetic separation of the particles is achieved. This may involve a single-step separation according to one specific susceptibility, or it may involve multiple separations according to several susceptibilities. The latter may be readily accomplished by varying the field strength of the isodynamic field and recycling the same equal-settling fractions through the separator.

Thereafter, the flow rate through the elutriator may be adjusted downward by a desired interval to provide a second equal-settling fraction for separation according to magnetic susceptibility. Such change in settling rate will produce a corresponding and proportional change in the flow rate through the chute 58 with the result that the velocity $V_L$ of particle flow through the magnetic field will always be such as to permit that degree of deflection to take place between the magnetic particles and the non-magnetic particles which will be productive of their separate recovery through the discharge outlets 68 and 70. Once again, the magnetic separation steps are carried out to the extent desired. Thereupon, still another equal-settling fraction of lower settling rate may be selected by reducing the elutriator flow rate by a further interval. Operation is continued in this way until particles of all settling rates of interest have been concentrated and magnetically separated.

EXAMPLE 1

Sixty grams of river mouth mud was wet sieved to obtain a mixture of particles ranging in size from that passed by a #140 sieve (106 micron opening) to that retained by a #325 sieve (45 micron opening). A 21 gram sample was selected from this mixture for magnetic separation in accordance with the invention. The sample over all was predominately light brown in color, with certain particles being predominately dark colored and other particles being predominately light gray.

The apparatus of FIG. 3 was used with water as the elutriant. The elutriating tube 46 was of the type illustrated in FIG. 6 and had an internal diameter of 6mm and nine plugs 92 with an orifice size of 3mm. The magnetic separator 44 was a Model L1 Frantz ISODYNAMIC separator equipped with a Plexiglass chute 58. The separator was oriented as shown in FIGS. 3 and 4 with the plane of the magnetic field and the transverse plane of the chute in the gravitational plane. The chute was inclined at an angle $\alpha$ of 30° to the horizontal (see FIG. 1).

With the flow rate through the tube 46 set such that all of the particles would be suspended above the uppermost plug in tube 46, the 21 gram sample was charged into the funnel 24. Thereafter, the flow rate was carefully adjusted downward by use of valve 34 until a moderate flow of particles through the tube 46 was observed. The light source 112, photocell 114 and valve 116 were not included in the test apparatus. With the elutriator flow rate setting held constant and the magnetic field off, the flow rate through the chute 58 was adjusted such that all of the particles delivered to the chute by the elutriator came out of the nonmagnetic outlet 70. Operation was continued at that elutriator flow rate until the frequency of particle flow through the tube 46 slowed substantially. Another downward adjustment in elutriator flow rate was then made by means of valve 34 to restore particle flow to the separator to a higher level and, with the magnetic field still off, a check was made to determine that all of the particles were confined to the nonmagnetic outlet 70 of the chute. Operation was continued until particle flow rate through the elutriator again fell off. Further downward adjustments of the elutriator flow rates were thereafter made until the entire 21 gram sample had been fed to the chute 58. The magnetic field remained off throughout these adjustments and, in each instance, all of the particles were observed to be confined to the nonmagnetic exit 70 of the chute.

This test showed that a proper proportionality was maintained between the chute flow rate and the elutriator flow rate for all particle settling rates within the sample. This is to say, the chute flow rate was proportionately reduced in response to each downward adjustment of the elutriator flow rate so as to confine particle flow through the chute 58, in the absence of an applied magnetic field, to the nonmagnetic outlet 70, thereby assuring that the discharge of particles through the magnetic outlet 72 in the presence of an applied field would be attributable to the magnetic properties of the particles.

EXAMPLE 2

Using the same apparatus set up and procedure as described in Example 1, the 21 gram sample was again introduced into the elutriator 22 and, by successive downward adjustments of the elutriator flow rate using valve 34, fed in a controlled manner to the magnetic separator 44. In this run, a DC current of 0.5 amperes was applied to the separator coils 60. Upon completion of the run, it was found that 2.27 grams of predominately dark colored particles had been collected through the magnetic outlet 72.

EXAMPLE 3

Again using the apparatus set up and procedure of Example 1, the nonmagnetic portion only obtained in Example 2, i.e., the particles collected in funnel 76, was reintroduced into the elutriator 22 and, in the manner described in Example 1, progressively fed to the separator 44. In this run, the DC current supplied to the magnetizing coils 60 was increased to 1.5 amperes. A fraction of 3.19 grams was collected through the magnetic outlet 72 and was predominately light brown in appearance. The nonmagnetic fraction weighed 15.47 grams and was predominately of a light grey color.

EXAMPLE 4

As a check on the reproducibility of the separation of Example 3, the 3.19 gram magnetic fraction obtained in Example 3 was rerun through the apparatus with the magnetizing coil current again set at 1.5 amperes. As before, the particles were progressively fed to the separator 44 by successive downward adjustments of the elutriator flow rate. In this run, 2.89 grams of predominately light brown particles were collected in the magnetic side container 78. Only 0.3 grams of particles were collected through the nonmagnetic outlet 70. These particles were predominately light grey in appearance.

EXAMPLE 5

The apparatus of FIG. 3 was equipped with an elutriating tube 46 having an internal diameter of 6mm and nine plugs 92 of 3mm diameter orifices. The separator 44 was a Frantz ISODYNAMIC separator, Model L1, and was provided with a Plexiglass chute 58 having a flow channel 66 of 0.13 $cm^2$ average cross sectional area. The elutriant was water. Liquid flow through the apparatus was adjusted using the by-pass valve 34 and was separately measured, at three different settings of valve 34, for the elutriator path and the separator path by collecting the flow from the nozzles 50 and 86, respectively, in the measuring tubes 52 and 88 and measuring the collection times with a stop watch. The volumetric flow rates for the two paths were as follows:

| | Chute Flow cc/sec | Elutriator Flow cc/sec | Ratio |
|---|---|---|---|
| (1) | 0.886 | 0.22 | 4.0 |
| (2) | 0.080 | 0.0196 | 4.1 |
| (3) | 0.0147 | 0.0036 | 4.1 |

These results indicate that the apparatus of FIG. 3 affords a substantially constant flow ratio between the two paths over a wide range of flow rates. Such stability in the flow rate ratio, as mentioned above, facilitates the separation according to magnetic susceptibility of fluid-suspended particles.

EXAMPLE 6

As a further check on the flow rate ratio stability of the apparatus of FIG. 3, another experiment was performed in which the elutriating tube 46 of Example 5 was replaced with a tube having an internal diameter of 10mm and 10 plugs with 5mm orifices. The apparatus of Example 5 was otherwise unchanged and the flow rates were determined in the same manner. The results were:

| | Chute Flow cc/sec | Elutriator Flow cc/sec | Ratio |
|---|---|---|---|
| (1) | 0.584 | 0.500 | 1.17 |
| (2) | 0.017 | 0.015 | 1.13 |
| (3) | 0.0018 | 0.0023 | 0.78 |

In this case, the ratio remained substantially constant with change in elutriator flow rate from 0.5 cc/sec to 0.015 cc/sec., but diverged somewhat when the elutriator flow rate was dropped by a further order of magnitude to 0.0023 cc/sec. It will be appreciated that it is difficult accurately to control flow rates at magnitudes as low as those of measurement (3), i.e., in the neighborhood of 0.002 cc/sec. At such low rates, for example, even a slight difference in the elevation of the nozzles 50 and 86 (FIG. 3) might cause the flow rate ratio to vary by the amount shown in measurement (3). If desired, the relative elevations of the two nozzles could be adjusted somewhat to move the ratio back to the original value.

Although the invention has been described and illustrated herein with reference to specific embodiments thereof, it will be understood that the invention is not limited to such specific embodiments but is subject to variation and modification without departing from the inventive concepts embodied therein. All such variations and modifications, therefore, are intended to be included within the scope of the appended claims.

We claim:

1. A method for separating a mixture of diverse-size particles in accordance with the magnetic susceptibilities of the particles, comprising:

flowing a fluid carrier upward through a first flow path in opposition to the settlement of the particles suspended therein due to gravity;

adjusting the upward rate of flow of the fluid carrier in said first path to select from said mixture a fraction of particles of a substantially uniform settling rate in the fluid carrier;

flowing said fraction suspended in the fluid carrier from the first flow path to a second flow path;

applying opposing magnetic and nonmagnetic forces to said fraction over at least a portion of said second flow path; and in response to said flow adjustment in the first flow path, adjusting the fluid flow rate through the second flow path so as to pass said fraction through said portion of the second flow path at a velocity proportionally related to the settling rate of the fraction in the first flow path such that the residence time of the fraction in said portion of the second flow path is sufficient to enable the separation therein of the fraction into relatively magnetic and relatively nonmagnetic portions by said opposing forces.

2. The method of claim 1 wherein the force applying step comprises establishing a magnetic field which is substantially isodynamic over the length of said portion of the second flow path.

3. The method of claim 1 further comprising:

repassing the relatively magnetic portion of the relatively nonmagnetic portion of said fraction through the first and second flow paths; and varying the strength of the applied magnetic force to separate said repassed portion into still further portions of different magnetic susceptibilities.

4. The method of claim 1 wherein:

said portion of said second flow path is inclined relative to the horizontal; and said opposing nonmagnetic force acting on said fraction over said second flow portion is a component of the gravitational force by virtue of said inclination.

5. The method of claim 1 further comprising the step of adjusting the upward fluid flow rate through the first flow path so as to control the density of particle flow to the second flow path.

6. The method of claim 1 wherein said applied magnetic and nonmagentic forces are substantially constant over the length of said portion of the second flow path.

7. The method of claim 1 further comprising:

sequentially adjusting the upward rate of flow of the fluid carrier in the first flow path by a number of intervals, sequentially to select from said mixture a corresponding number of fractions, each of which is of a different substantially uniform settling rate in the fluid carrier;

flowing each of said fractions suspended in the fluid carrier from the first flow path to the second flow path; and in response to said flow interval adjustments in the first flow path, sequentially adjusting the fluid flow rate through the second flow path so as to pass each of said fractions through said portion of the second flow path at a velocity proportionally related to the settling rate of said each fraction in the first flow path such that the residence time of said each fraction in said portion of the second flow path is sufficient to enable the separation therein of said each fraction into relatively magnetic and relatively nonmagnetic portions by said opposing forces.

8. A method for separating a mixture of diverse-size particles in accordance with the magnetic susceptibilities of the particles, comprising:

flowing a fluid carrier upward through a first flow path in opposition to the settlement of the particles suspended therein due to gravity;

adjusting the upward rate of flow of the fluid carrier in said first path by one or more intervals to select from said mixture one or more fractions of substantially uniform settling rates in the fluid carrier;

flowing each of said one or more fractions suspended in the fluid carrier from the first flow path to a second flow path;

establishing a magnetic field extending over at least a portion of said second flow path; and in response to said one or more flow interval adjustments in the first flow path, adjusting the fluid flow rate through the second flow path so as to pass each of said one or more fractions through the magnetic field at a velocity proportional to the settling rate of the fraction in the first flow path, thereby to enable separation of said fractions into relatively magnetic and relatively nonmagnetic portions within the active length of the field, said adjustments of the second path flow rate being such as to maintain the ratio of the velocity at which each fraction is passed through the magnetic field to the settling velocity of said each fraction in the first flow path at a substantially constant value.

9. The method of claim 7 wherein the fluid flow rate through the second flow path is so adjusted in response to said sequential flow interval adjustments in the first flow path as to maintain the ratio of the velocity at which each fraction is passed through said portion of the second flow path to the settling velocity of said each fraction in the first flow path at a substantially constant value.

10. The method of claim 9 wherein the first flow path and the second flow path are supplied from a common fluid source, and wherein the fluid flows from the first and second flow paths are returned to the fluid source to provide for continuous operation.

11. Apparatus for separating a mixture of diverse-size particles in accordance with the magnetic susceptibilities of the particles, comprising:

a source of fluid carrier;

means defining a first flow path communicating with the fluid source for flowing the fluid carrier upward in opposition to the settlement therein due to gravity of said mixture of diverse-size particles;

means for adjusting the upward rate of flow of the fluid carrier in said first flow path to select from said mixture a fraction of particles of a substantially uniform settling rate in the fluid carrier;

means defining a second flow path communicating with the fluid source and with the first flow path for receiving said fraction suspended in the fluid carrier;

means for applying opposing magnetic and nonmagnetic forces to said fraction over at least a portion of the second flow path; and means responsive to said flow adjustment in the first flow path for passing said fraction through said portion of the second flow path at a velocity proportionally related to the settling rate of the fraction in the first flow path such that the residence time of the fraction in said portion of the second flow path is sufficient to enable the separation therein of the fraction into relatively magnetic and relatively nonmagnetic portions by said opposing forces.

12. The apparatus of claim 11 wherein the flow adjustment means for the first flow path include means for controlling the density of particle flow to the second flow path.

13. The apparatus of claim 11 wherein said density controlling means includes:

means for monitoring the flow of particles settling out of the first flow path; and means responsive to the monitoring means for adjusting the upward flow rate through the first flow path to provide a desired particle flow density to the second flow path.

14. The apparatus of claim 11 wherein the force applying means includes means for establishing a magnetic field which is substantially isodynamic in character over the length of said portion of the second flow path.

15. The apparatus of claim 11 wherein the field establishing means includes means for varying the intensity of the magnetic field to permit the separation of particles of different magnetic susceptibilities.

16. The apparatus of claim 11 wherein:

said portion of the second flow path is inclined relative to the horizontal; and said opposing nonmagnetic force acting on said fraction over said second flow path portion is a component of the gravitational force by virtue of said inclination.

17. The apparatus of claim 11 wherein the first and second flow paths defining means include means for recirculating the fluid carrier to the fluid source to provide for continuous operation.

18. The apparatus of claim 11 wherein said force applying means comprises means for applying substantially constant magnetic and nonmagnetic forces over the length of said portion of the second flow path.

19. The apparatus of claim 11 wherein said flow adjustment means for the first flow path includes means for sequentially adjusting the upward rate of flow of the fluid carrier in the first flow path by a number of intervals, sequentially to select from said mixture a corresponding number of fractions, each of which is of a different substantially uniform settling rate in the fluid carrier and flows from the first flow path to the second flow path; and wherein said flow adjustment responsive means includes means for sequentially adjusting the fluid flow rate through the second flow path so as to pass each of said fractions through said portion of the second flow path at a velocity proportionally related to the settling rate of said each fraction in the first flow path such that the residence time of said each fraction in said portion of the second flow path is sufficient to enable the separation therein of said each fraction into relatively magnetic and relatively nonmagnetic portions by said opposing forces.

20. The apparatus of claim 19 wherein said flow adjustment responsive means includes means for maintaining the ratio of the velocity at which each fraction is passed through said portion of the second flow path to the settling rate of said each fraction in the first flow path at a substantially constant value.

21. The apparatus of claim 20 wherein said ratio maintaining means comprises:

means, including said fluid source, for maintaining a substantially equal pressure drop across each of the first and second flow paths; and said means for adjusting the upward rate of flow of the fluid carrier in said first flow path comprises means for supplying fluid carrier to said fluid source and means for controlling the rate of supply of the fluid carrier to the fluid source, whereby the respective flow rates of the fluid carrier through the first and second flow paths are simultaneously controlled in proportion to the change in the flow rate to the fluid source.

22. Apparatus for separating a mixture of diverse-size particles in accordance with the magnetic susceptibilities of the parties, comprising:

a source of fluid carrier:

means defining a first flow path communicating with the fluid source for flowing the fluid carrier upward in opposition to the settlement therein due to gravity of said mixture of diverse-size particles;

means for adjusting the upward rate of flow of the fluid carrier in said first path by one or more intervals to select from said mixture one or more fractions of particles of substantially uniform settling rates in the fluid carrier, said flow adjustment means further including means for monitoring the flow of particles settling out of the first flow path and, in response thereto, for adjusting the upward flow rate through the first flow path to provide a desired particle flow density therefrom;

means for establishing a magnetic field; and means defining a second flow path communicating with the first flow path for receiving said one or more fractions suspended in the fluid carrier and, in response to said one or more flow interval adjustments in the first flow path, for passing each of said one or more fractions through said magnetic field at a velocity proportional to the settling rate of said each fraction in the first flow path, thereby to enable separation of said fractions into relatively magnetic and relatively nonmagnetic portions within the active length of the field.

* * * * *

UNITED STATES PATENT OFFICE

CERTIFICATE OF CORRECTION

Patent No. 4,102,780 Dated July 25, 1978

Inventor(s) Jack Ji-Nong Sun and Dartrey Lewis

It is certified that error appears in the above-identified patent and that said Letters Patent are hereby corrected as shown below:

Column 16, line 21, "portion of" should read -- portion or --;

Column 16, line 39, "nonmagentic" should read -- nonmagnetic --; and

Column 18, line 3, "claim 11" should read -- claim 12 --.

Signed and Sealed this

Sixth Day of February 1979

[SEAL]

Attest:

RUTH C. MASON
*Attesting Officer*

DONALD W. BANNER
*Commissioner of Patents and Trademarks*